US010315170B2

(12) United States Patent
Maeda et al.

(10) Patent No.: US 10,315,170 B2
(45) Date of Patent: Jun. 11, 2019

(54) FINE BUBBLE-CONTAINING LIQUID GENERATING APPARATUS

(71) Applicant: IDEC CORPORATION, Osaka (JP)

(72) Inventors: Shigeo Maeda, Osaka (JP); Masakazu Kashiwa, Osaka (JP); Katsuhisa Ida, Osaka (JP)

(73) Assignee: IDEC Corporation (JP)

( * ) Notice: Subject to any disclaimer, the term of this patent is extended or adjusted under 35 U.S.C. 154(b) by 252 days.

(21) Appl. No.: 15/126,865

(22) PCT Filed: Mar. 3, 2015

(86) PCT No.: PCT/JP2015/056185
§ 371 (c)(1),
(2) Date: Sep. 16, 2016

(87) PCT Pub. No.: WO2015/141459
PCT Pub. Date: Sep. 24, 2015

(65) Prior Publication Data

US 2017/0087522 A1 Mar. 30, 2017

(30) Foreign Application Priority Data

Mar. 20, 2014 (JP) ..... 2014-058168

(51) Int. Cl.
*B01F 3/04* (2006.01)
*B01F 5/04* (2006.01)
(Continued)

(52) U.S. Cl.
CPC ..... *B01F 3/04248* (2013.01); *B01F 3/04503* (2013.01); *B01F 3/04744* (2013.01);
(Continued)

(58) Field of Classification Search
CPC ..... B01F 3/04248; B01F 3/04503; B01F 3/04744; B01F 5/043; B01F 5/106; B01F 15/00233; B01F 15/00344
(Continued)

(56) References Cited

U.S. PATENT DOCUMENTS 3,900,420 A * 8/1975 Sebba ..... B01F 3/04439 210/758
4,019,983 A * 4/1977 Mandt ..... B01F 5/0212 210/220
(Continued)

FOREIGN PATENT DOCUMENTS

EP 2 292 321 A1 3/2011
JP 63-178833 7/1988
(Continued)

OTHER PUBLICATIONS

Notification Concerning Transmitaal of International Preliminary Report on Patentability including PCT/IB/373 and PCT/ISA/237 (in Japanese) dated Sep. 29, 2016.
(Continued)

*Primary Examiner* — Charles S Bushey
(74) *Attorney, Agent, or Firm* — Ostrolenk Faber LLP

(57) ABSTRACT

A fine bubble-containing liquid generating apparatus includes a generator including a mixing nozzle for leading in gas and pressurized liquid and a fine-bubble generating nozzle for discharging liquid that contains fine bubbles of the led-in gas, a circulation passage for returning liquid discharged from the fine-bubble generating nozzle to the mixing nozzle in a state in which the liquid is isolated from outside air, an extraction part for extracting, as a fine-bubble containing liquid, part of liquid circulating through the generator and the circulation passage, and a replenisher for replenishing the circulation passage with liquid to maintain the amount of liquid circulating through the generator and
(Continued)

the circulation passage. With this configuration, it is possible to continuously generate a fine-bubble containing liquid that contains a high density of fine bubbles.

20 Claims, 6 Drawing Sheets

(51) Int. Cl.
*B01F 5/10* (2006.01)
*B01F 15/00* (2006.01)

(52) U.S. Cl.
CPC ..... *B01F 5/043* (2013.01); *B01F 5/106* (2013.01); *B01F 15/00233* (2013.01); *B01F 15/00344* (2013.01)

(58) Field of Classification Search
USPC ..... 261/27, 76, DIG. 75
See application file for complete search history.

(56) References Cited

U.S. PATENT DOCUMENTS

| | | | | |
|---|---|---|---|---|
| 4,639,340 | A * | 1/1987 | Garrett | B01F 3/0876 261/36.1 |
| 4,744,956 | A * | 5/1988 | Yant | B01J 19/2465 261/76 |
| 4,900,480 | A | 2/1990 | Litz et al. | 261/36.1 |
| 5,316,682 | A * | 5/1994 | Keyser | B01F 5/0476 210/195.2 |
| 5,824,243 | A * | 10/1998 | Contreras | B01F 5/106 261/36.1 |
| 6,054,046 | A * | 4/2000 | Nelson | B01D 19/001 210/194 |
| 6,250,609 | B1 * | 6/2001 | Cheng | B01F 3/04468 261/140.1 |
| 2001/0045673 | A1 * | 11/2001 | Ogston | B01F 3/0446 261/76 |
| 2004/0238975 | A1 | 12/2004 | Sakakibara et al. | 261/100 |
| 2008/0272211 | A1 * | 11/2008 | Rann | B01F 3/04815 239/410 |
| 2009/0117241 | A1 | 5/2009 | Tsuji | 426/460 |
| 2012/0160330 | A1 | 6/2012 | Cadeo et al. | 137/1 |
| 2014/0054243 | A1 * | 2/2014 | Hummer | B63J 4/002 210/757 |

FOREIGN PATENT DOCUMENTS

| | | |
|---|---|---|
| JP | 10-066850 | 3/1998 |
| JP | 10-094722 | 4/1998 |
| JP | 10-244138 | 9/1998 |
| JP | 11-076780 | 3/1999 |
| JP | 2006-198557 | 8/2006 |
| JP | 2008-272719 | 11/2008 |
| JP | 2009-075121 | 4/2009 |
| JP | 2009-236327 | 10/2009 |
| JP | 2011-005445 | 1/2011 |
| JP | 2011-056498 | 3/2011 |
| JP | 2011-224519 A | 11/2011 |
| JP | 2012-530595 | 12/2012 |
| JP | 2013-154342 A | 8/2013 |
| JP | 2013-223824 | 10/2013 |
| JP | 2014-012255 | 1/2014 |

OTHER PUBLICATIONS

Notification of Transmittal of Translation of the International Preliminary Report on Patentability including PCT/IB/373 and PCT/ISA/237 (in English) dated Sep. 29, 2016.

International Search Report dated Jun. 9, 2015 in corresponding PCT International Application No. PCT/JP2015/056185.

Written Opinion dated Jun. 9, 2015 in corresponding PCT International Application No. PCT/JP2015/056185.

Extended European Search Report dated Feb. 24, 2017 in corresponding European Patent Application No. 15765644.8.

* cited by examiner

FINE BUBBLE-CONTAINING LIQUID GENERATING APPARATUS

CROSS-REFERENCE TO RELATED APPLICATIONS

The present application is a 35 §§ 371 national phase conversion of PCT/JP2015/056185, filed Mar. 3, 2015, which claims priority to Japanese Patent Application No. 2014-058168, filed Mar. 20, 2014, the contents of both of which are incorporated herein by reference. The PCT International Application was published in the Japanese language.

TECHNICAL FIELD

The present invention relates to a fine bubble-containing liquid generating apparatus.

BACKGROUND ART

In recent years, liquids containing bubbles with diameters of 1 millimeter (mm) or less have been used in various fields. Also, liquids containing bubbles with diameters of 1 micrometer (μm) or less (ultrafine bubbles) have recently been gathering attention in various fields, and apparatuses for generating such liquids have been proposed.

For example, in a fine-bubble generating apparatus disclosed in Japanese Patent Application Laid-Open No. 2008-272719 (Document 1), a gas-liquid mixed fluid sent from a pump is broken up into fine bubbles by a gas swirling shearing unit and then sent to a liquid storage tank and stored. In Document 1, the liquid in the liquid storage tank is repeatedly circulated to the gas swirling shearing unit in order to increase the density of fine bubbles in the liquid (i.e., the number of fine bubbles per unit volume).

Incidentally, Document 1 describes the liquid stored in the storage tank being extracted and used in various applications. However, the fine-bubble generating apparatus of Document 1 is a batch type apparatus that can generate an amount of liquid that can be stored in the storage tank, and cannot continuously generate and supply a liquid that contains a high density of fine bubbles.

SUMMARY OF INVENTION

The present invention is intended for a fine bubble-containing liquid generating apparatus, and it is an object of the present invention to continuously generate a fine-bubble containing liquid that contains a high density of fine bubbles.

The fine bubble-containing liquid generating apparatus according to the present invention includes a generator including a lead-in part for leading in gas and pressurized liquid, and a discharge part for discharging liquid that contains fine bubbles of the gas led in from the lead-in part, a circulation passage for returning liquid discharged from the discharge part to the lead-in part in a state in which the liquid is isolated from outside air, an extraction part for extracting, as a fine-bubble containing liquid, part of liquid circulating through the generator and the circulation passage, and a replenisher for replenishing the circulation passage with liquid to maintain an amount of liquid circulating through the generator and the circulation passage.

With this fine bubble-containing liquid generating apparatus, it is possible to continuously generate a fine-bubble containing liquid that contains a high density of fine bubbles.

In a preferred embodiment of the present invention, the fine bubble-containing liquid generating apparatus further includes a drain passage that branches off from the circulation passage and is connected to a drain port, and a switching mechanism for switching a delivery destination of liquid discharged from the discharge part between the lead-in part and the drain port. In a state prior to starting extraction of the fine-bubble containing liquid from the extraction part, the liquid led in from the replenisher to the lead-in part through the circulation passage is guided from the discharge part to the drain port by the switching mechanism.

In another preferred embodiment of the present invention, the fine bubble-containing liquid generating apparatus further includes a bypass passage that branches off from the circulation passage and is connected to the circulation passage on a downstream side of a branch point, an initial reservoir provided on the bypass passage and for storing liquid, and a switching mechanism provided between the circulation passage and the bypass passage. The switching mechanism performs switching such that prior to starting extraction of the fine-bubble containing liquid from the extraction part, the liquid discharged from the discharge part is guided to the initial reservoir through the bypass passage, temporally stored in the initial reservoir, and returned to the lead-in part through the bypass passage, and during the extraction of the fine-bubble containing liquid from the extraction part, the liquid discharged from the discharge part is returned to the lead-in part through the circulation passage.

In another preferred embodiment of the present invention, the replenisher includes a liquid supply passage for guiding liquid pumped from a liquid supply source to the circulation passage, and a pressure controller provided on the liquid supply passage and for controlling a pressure of liquid flowing through the liquid supply passage.

In another preferred embodiment of the present invention, the replenisher includes a liquid supply passage for guiding liquid from a liquid supply source to the circulation passage, and a pump provided on the liquid supply passage and for pumping liquid in the liquid supply passage toward the circulation passage.

In another preferred embodiment of the present invention, the fine bubble-containing liquid generating apparatus further includes a replenishment controller for controlling a pressure or flow rate of liquid supplied from the replenisher to the circulation passage, on the basis of an extraction flow rate of the fine-bubble containing liquid from the extraction part.

In another preferred embodiment of the present invention, the fine bubble-containing liquid generating apparatus further includes a bubble-density measuring part for measuring a density of fine bubbles in the fine-bubble containing liquid to be extracted from the extraction part, a storage for storing flow-rate/density information that indicates a relationship between an extraction flow rate of the fine-bubble containing liquid from the extraction part and a density of fine bubbles in the fine-bubble containing liquid to be extracted from the extraction part, and an extraction controller for controlling an extraction flow rate of the fine-bubble containing liquid from the extraction part, on the basis of a measurement result obtained by the bubble-density measuring part and the flow-rate/density information.

These and other objects, features, aspects and advantages of the present invention will become more apparent from the following detailed description of the present invention when taken in conjunction with the accompanying drawings.

DESCRIPTION OF EMBODIMENTS

Figure 1:
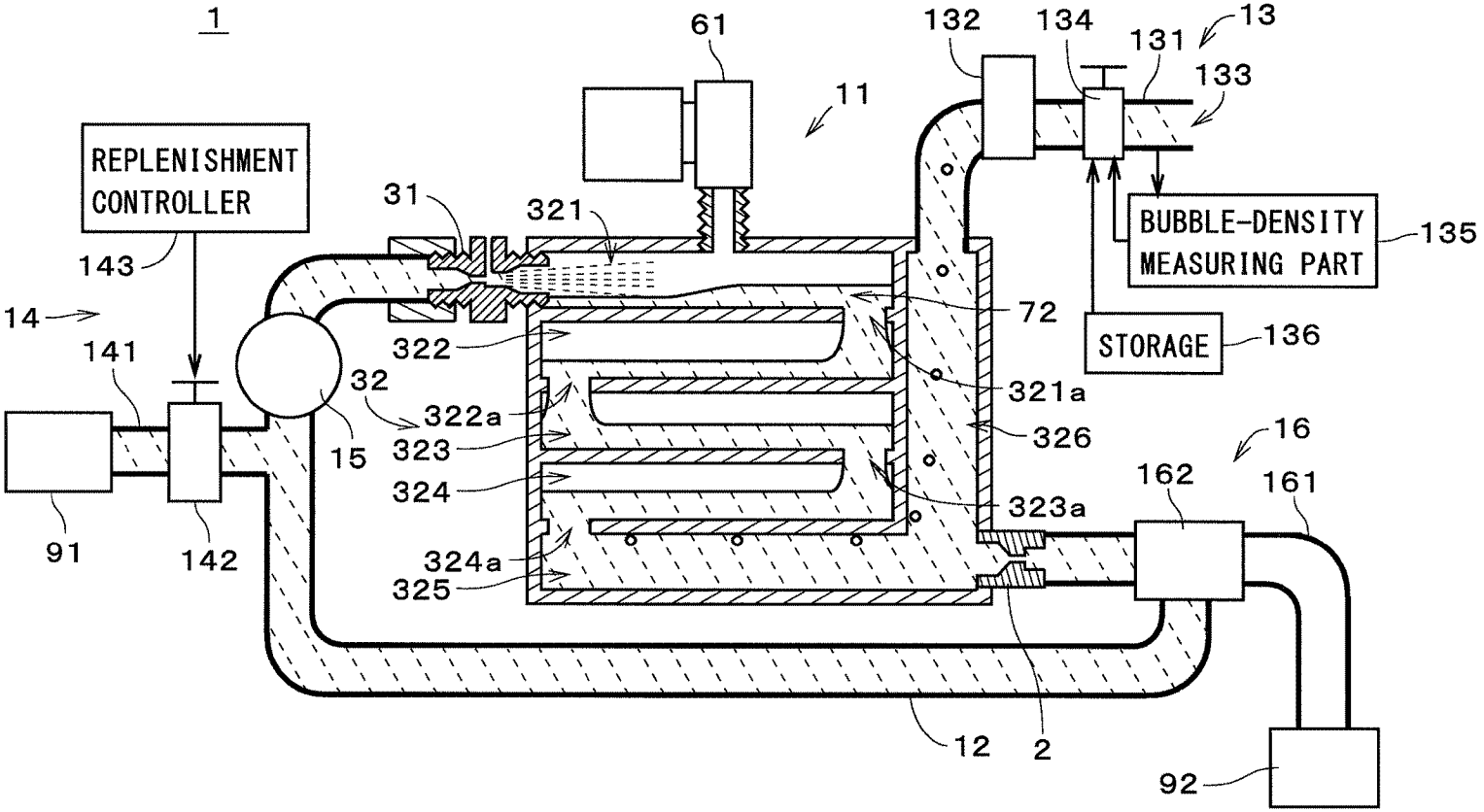
FIG. 1 is a cross-sectional view of a fine bubble-containing liquid generating apparatus according to a first embodiment.

FIG. 1 is a cross-sectional view of a fine bubble-containing liquid generating apparatus 1 according to a first embodiment of the present invention. The fine bubble-containing liquid generating apparatus 1 is an apparatus for mixing gas and liquid to generate a liquid that contains fine bubbles of the liquid. In the following description, "fine bubbles" refers to bubbles with diameters of 100 μm or less, and "ultrafine bubbles" refers to fine bubbles with diameters of 1 μm or less. The "density" of fine bubbles refers to the number of fine bubbles per unit volume contained in the liquid.

The fine bubble-containing liquid generating apparatus 1 includes a generator 11, a circulation passage 12, an extraction part 13, a replenisher 14, a pump 15, and a drain part 16. The generator 11 includes a mixing nozzle 31, a pressurized-liquid generating tank 32, and a fine-bubble generating nozzle 2. The mixing nozzle 31 mixes liquid pumped by the pump 15 and gas flowing from a gas inlet and ejects a resultant mixed fluid 72 into the pressurized-liquid generating tank 32. The liquid and gas mixed in the mixing nozzle 31 are, for example, deionized water and a nitrogen gas.

Figure 2:
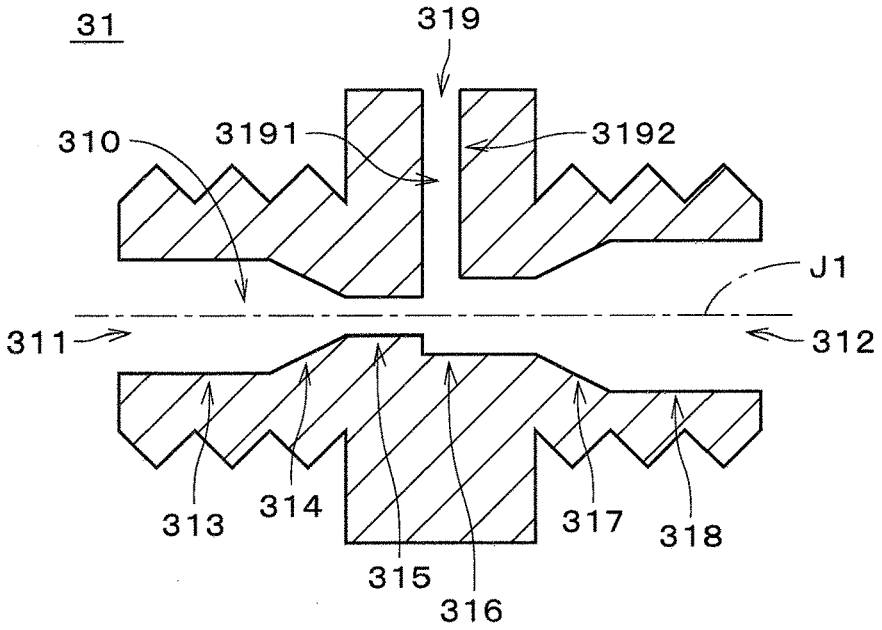
FIG. 2 is a cross-sectional view of a mixing nozzle.

FIG. 2 is an enlarged cross-sectional view of the mixing nozzle 31. The mixing nozzle 31 includes a liquid inlet 311 for intake of the liquid pumped by the pump 15, a gas inlet 319 for intake of the gas, and a mixed-fluid outlet 312 for ejection of the mixed fluid 72. The mixed fluid 72 is generated by mixing the liquid flowing from the liquid inlet 311 and the gas flowing from the gas inlet 319. The liquid inlet 311, the gas inlet 319, and the mixed-fluid outlet 312 have generally circular shapes. A nozzle flow passage 310 that extends from the liquid inlet 311 to the mixed-fluid outlet 312 and a gas flow passage 3191 that extends from the gas inlet 319 to the nozzle flow passage 310 also have generally circular flow passage cross-sectional shapes. Here, "flow passage cross-sections" refer to cross-sections perpendicular to central axes of flow passages such as the nozzle flow passage 310 and the gas flow passage 3191, i.e., cross-sections perpendicular to the flow of fluid in the flow passages. In the following description, the area of a flow passage cross-section is referred to as a "flow passage area."

The nozzle flow passage 310 is in the shape of a venturi tube whose flow passage area decreases in the middle portion of the flow passage.

The mixing nozzle 31 includes a lead-in part 313, a first tapered part 314, a throat part 315, a gas mixing part 316, a second tapered part 317, and a lead-out part 318 that are arranged sequentially in order from the liquid inlet 311 toward the mixed-fluid outlet 312. The mixing nozzle 31 further includes a gas supply part 3192 that includes the gas flow passage 3191.

The lead-in part 313 has a flow passage area that is approximately constant at each position in the direction of a central axis J1 of the nozzle flow passage 310. The first tapered part 314 has a flow passage area that gradually decreases in the direction of flow of the liquid (i.e., toward the downstream side). The throat part 315 has an approximately constant flow passage area. The throat part 315 has the smallest flow passage area in the nozzle flow passage 310. Note that even if the throat part 315 has a flow passage area that changes slightly, the entire part of the nozzle flow passage 310 that has roughly the smallest flow passage area is regarded as the throat part 315. The gas mixing part 316 has an approximately constant flow passage area that is slightly larger than the flow passage area of the throat part 315. The second tapered part 317 has a flow passage area that gradually increases to the downstream side. The lead-out part 318 has an approximately constant flow passage area. The gas flow passage 3191 also has an approximately constant flow passage area, and is connected to the gas mixing part 316 of the nozzle flow passage 310.

In the mixing nozzle 31, the liquid flowing from the liquid inlet 311 into the nozzle flow passage 310 is caused to accelerate in the throat part 315 and thus has reduced static pressure, as a result of which the pressure in the throat part 315 and the gas mixing part 316 of the nozzle flow passage 310 falls to a value lower than atmospheric pressure. This causes the gas to be drawn in from the gas inlet 319 by suction, flow into the gas mixing part 316 through the gas flow passage 3191, and be mixed with the liquid to generate the mixed fluid 72. The mixed fluid 72 is caused to decelerate in the second tapered part 317 and the lead-out part 318 and thus has increased static pressure, as a result of which the mixed fluid 72 is ejected through the mixed-fluid outlet 312 into the pressurized-liquid generating tank 32 as described above.

The interior of the pressurized-liquid generating tank 32 illustrated in FIG. 1 is pressurized to a state (hereinafter referred to as a "pressurized environment") in which the pressure is higher than atmospheric pressure. In the pressurized-liquid generating tank 32, the gas is dissolved in the liquid under pressure and a pressurized liquid is generated while the fluid (hereinafter, referred to as "mixed fluid 72") obtained by mixing the liquid and gas ejected from the mixing nozzle 31 flows in the pressurized environment.

The pressurized-liquid generating tank 32 includes a first flow passage 321, a second flow passage 322, a third flow passage 323, a fourth flow passage 324, and a fifth flow passage 325 that are stacked in the up-down direction. In the following description, the first flow passage 321, the second flow passage 322, the third flow passage 323, the fourth flow passage 324, and the fifth flow passage 325 may be collectively referred to as "flow passages 321 to 325." The flow passages 321 to 325 extend in the horizontal direction and have generally rectangular cross-sectional shapes perpendicular to the lengths of the flow passages 321 to 325.

The upstream end (i.e., the end on the left side in FIG. 1) of the first flow passage 321 is attached to the aforementioned mixing nozzle 31, and the mixed fluid 72 ejected from the mixing nozzle 31 flows to the right side in FIG. 1 in the pressurized environment. In the present embodiment, the mixed fluid 72 is ejected from the mixing nozzle 31 upward of the liquid surface of the mixed fluid 72 flowing in the first flow passage 321, and the mixed fluid 72 that has just been ejected collides directly with the liquid surface before colliding with the downstream wall surface (i.e., wall surface on the right side in FIG. 1) of the first flow passage 321. In order to cause the mixed fluid 72 ejected from the mixing nozzle 31 to collide directly with the liquid surface, the length of the first flow passage 321 is preferably 7.5 times greater than the distance in the up-down direction between the center of the mixed-fluid outlet 312 (see FIG. 2) of the mixing nozzle 31 and the lower surface of the first flow passage 321.

In the pressurized-liquid generating tank 32, the mixed-fluid outlet 312 of the mixing nozzle 31 may be located partially or entirely below the liquid surface of the mixed fluid 72 flowing in the first flow passage 321. In this case, in the first flow passage 321, the mixed fluid 72 that has just been ejected from the mixing nozzle 31 collides directly with the mixed fluid 72 flowing in the first flow passage 321 as described above.

The lower surface at the downstream end of the first flow passage 321 has a generally circular opening 321*a*, and the mixed fluid 72 flowing in the first flow passage 321 drops through the opening 321*a* into the second flow passage 322 located below the first flow passage 321. In the second flow passage 322, the mixed fluid 72 dropping from the first flow passage 321 flows from the right side to the left side in FIG. 1 in the pressurized environment and drops through a generally circular opening 322*a*, which is formed in the lower surface at the downstream end of the second flow passage 322, into the third flow passage 323 located below the second flow passage 322. In the third flow passage 323, the mixed fluid 72 dropping from the second flow passage 322 flows from the left side to the right side in FIG. 1 in the pressurized environment and drops through a generally circular opening 323*a*, which is formed in the lower surface at the downstream end of the third flow passage 323, into the fourth flow passage 324 located below the third flow passage 323. As illustrated in FIG. 1, the mixed fluid 72 flowing in the first to fourth flow passages 321 to 324 is divided into a liquid layer that contains bubbles and a gas layer that is located above the liquid layer.

In the fourth flow passage 324, the mixed fluid 72 dropping from the third flow passage 323 flows from the right side to the left side in FIG. 1 in the pressurized environment and flows (i.e., drops) through a generally circular opening 324*a*, which is formed in the lower surface at the downstream end of the fourth flow passage 324, into the fifth flow passage 325 located below the fourth flow passage 324. Unlike in the first to fourth flow passages 321 to 324, there is no gas layer in the fifth flow passage 325, and the liquid that fills the fifth flow passage 325 contains few bubbles in the vicinity of the upper surface of the fifth flow passage 325. In the fifth flow passage 325, the mixed fluid 72 from the fourth flow passage 324 flows from the left side to the right side in FIG. 1 in the pressurized environment.

In the pressurized-liquid generating tank 32, the gas in the mixed fluid 72, which flows from top to bottom in the flow passages 321 to 325 while accelerating and decelerating in stages (i.e., flows while repeatedly alternating between a horizontal flow and a downward flow), is gradually dissolved in the liquid under pressure. In the fifth flow passage 325, the concentration of the gas dissolved in the liquid is approximately equal to 60 to 90% of the (saturated) solubility of the gas in the pressurized environment. Excess gas that was not dissolved in the liquid remains as visible bubbles in the fifth flow passage 325. Since the directions of flow of the mixed fluid 72 are opposite in the horizontal flow passages 321 to 325 that are vertically adjacent to each other, the size of the pressurized-liquid generating tank 32 can be reduced.

The pressurized-liquid generating tank 32 further includes an excess-gas separating part 326 that extends upward from the downstream upper surface of the fifth flow passage 325. The excess-gas separating part 326 is filled with the mixed fluid 72. The excess-gas separating part 326 has a generally rectangular cross-sectional shape perpendicular to the up-down direction, and the upper end of the excess-gas separating part 326 is connected to the extraction part 13. Bubbles in the mixed fluid 72 flowing in the fifth flow passage 325 travel upward toward the extraction part 13 within the excess-gas separating part 326. The details of the extraction part 13 will be described later.

By separating the excess gas in the mixed fluid 72 along with part of the mixed fluid 72 in this way, a pressurized liquid that substantially does not contain at least readily visible bubbles is generated and supplied to the fine-bubble generating nozzle 2, which is directly connected to the downstream end of the fifth flow passage 325. In the present embodiment, the gas dissolved in the pressurized liquid 71 has a (saturated) solubility that is approximately two or more times that of the gas under atmospheric pressure. In the pressurized-liquid generating tank 32, the liquid in the mixed fluid 72 flowing in the flow passages 321 to 325 can also be regarded as a pressurized liquid that is in the process of being generated.

An exhaust valve 61 is also provided above the first flow passage 321. When the pump 15 is stopped, the exhaust valve 61 is opened to prevent the mixed fluid 72 from flowing back to the mixing nozzle 31.

Figure 3:
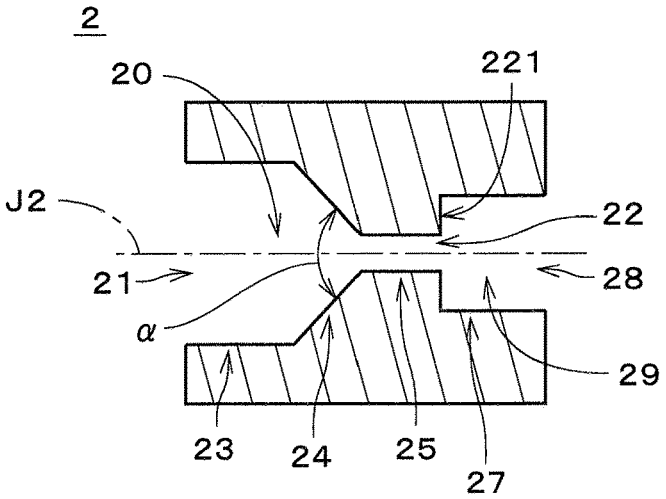
FIG. 3 is a cross-sectional view of a fine-bubble generating nozzle.

FIG. 3 is an enlarged cross-sectional view of the fine-bubble generating nozzle 2. The fine-bubble generating nozzle 2 includes a pressurized-liquid inlet 21 for intake of the pressurized liquid from the fifth flow passage 325 of the pressurized-liquid generating tank 32, and a pressurized-liquid outlet 22 that is open to the circulation passage 12. The pressurized-liquid inlet 21 and the pressurized-liquid outlet 22 have generally circular shapes, and a nozzle flow passage 20 that extends from the pressurized-liquid inlet 21 to the pressurized-liquid outlet 22 also has a generally circular flow passage cross-sectional shape.

The fine-bubble generating nozzle 2 includes a lead-in part 23, a tapered part 24, and a throat part 25 that are arranged sequentially in order from the pressurized-liquid inlet 21 to the pressurized-liquid outlet 22. The lead-in part 23 has a flow passage area that is approximately constant at each position in the direction of a central axis J2 of the nozzle flow passage 20. The tapered part 24 has a flow passage area that gradually decreases in the direction of flow of the pressurized liquid (i.e., to the downstream side). The inner surface of the tapered part 24 is part of a generally circular conical surface centered on the central axis J2 of the nozzle flow passage 20. In a cross-section including the central axis J2, an angle $\alpha$ formed by the inner surface of the tapered part 24 is preferably greater than or equal to 10° and less than or equal to 90°.

The throat part 25 connects the tapered part 24 with the pressurized-liquid outlet 22. The inner surface of the throat part 25 is a generally cylindrical surface, and the flow passage area of the throat part 25 is approximately constant.

The flow passage cross-section of the throat part 25 has the smallest diameter in the nozzle flow passage 20, and the flow passage area of the throat part 25 is the smallest in the nozzle flow passage 20. The length of the throat part 25 is preferably greater than or equal to 1.1 times the diameter of the throat part 25 and less than or equal to 10 times the diameter thereof, and more preferably greater than or equal to 1.5 times the diameter of the throat part 25 and less than or equal to 2 times the diameter thereof. Note that even if the throat part 25 has a flow passage area that changes slightly, the entire part of the nozzle flow passage 20 that has roughly the smallest flow passage area is regarded as the throat part 25.

The fine-bubble generating nozzle 2 further includes an enlarged part 27 that communicates with the throat part 25 and surrounds the pressurized-liquid outlet 22 while being spaced from the pressurized-liquid outlet 22, and an enlarged-part opening 28 provided at the end of the enlarged part 27. A flow passage 29 is provided between the pressurized-liquid outlet 22 and the enlarged-part opening 28 outside the pressurized-liquid outlet 22, and is hereinafter referred to as an "external flow passage 29." The external flow passage 29 and the enlarged-part opening 28 have generally circular flow passage cross-sectional shapes, and the external flow passage 29 has an approximately constant flow passage area. The diameter of the external flow passage 29 is greater than the diameter of the throat part 25 (i.e., the diameter of the pressurized-liquid outlet 22).

In the following description, an annular surface between the edge of the inner peripheral surface of the enlarged part 27 on the pressurized-liquid outlet 22 side and the edge of the pressurized-liquid outlet 22 is referred to as an "outlet end surface 221." In the present embodiment, an angle formed by the outlet end surface 221 and the central axis J2 of both the nozzle flow passage 20 and the external flow passage 29 is approximately 90°. The diameter of the external flow passage 29 is in the range of 10 to 20 mm, and the length of the external flow passage 29 is approximately equal to the diameter of the external flow passage 29. In the fine-bubble generating nozzle 2, the external flow passage 29, which is a recessed part, can be regarded as being formed at the end on the side opposite to the pressurized-liquid inlet 21, and the pressurized-liquid outlet 22, which is an opening smaller than the bottom of the recessed part, can be regarded as being formed at the bottom of the recessed part. The enlarged part 27 has an enlarged flow passage area for the pressurized liquid between the pressurized-liquid outlet 22 and the circulation passage 12.

In the fine-bubble generating nozzle 2, the pressurized liquid flowing from the pressurized-liquid inlet 21 into the nozzle flow passage 20 flows toward the throat part 25 while gradually accelerating in the tapered part 24, passes through the throat part 25, and is ejected as a jet from the pressurized-liquid outlet 22. The flow velocity of the pressurized liquid in the throat part 25 is preferably in the range of 10 to 30 meters per second. Since the static pressure of the pressurized liquid decreases in the throat part 25, the gas in the pressurized liquid becomes supersaturated and is precipitated as fine bubbles into the liquid. The fine bubbles pass through the external flow passage 29 of the enlarged part 27, along with the pressurized liquid. In the fine bubble generation nozzle 2, the precipitation of fine bubbles occurs even while the pressurized liquid is passing through the external flow passage 29. Thus, a liquid containing fine bubbles is generated and supplied to the circulation passage 12. The fine bubbles generated by the fine-bubble generating nozzle 2 primarily include ultrafine bubbles.

In the generator 11 illustrated in FIG. 1, the mixing nozzle 31 is a lead-in part for leading in the gas and the liquid pressurized by the pump 15 to the pressurized-liquid generating tank 32. The fine-bubble generating nozzle 2 is a discharge part for discharging a liquid that contains fine bubbles of the gas led in from the mixing nozzle 31, to the circulation passage 12.

One end of the circulation passage 12 is connected to the enlarged-part opening 28 (see FIG. 3) of the fine-bubble generating nozzle 2, and the other end is connected to the liquid inlet 311 (see FIG. 2) of the mixing nozzle 31. The aforementioned pump 15 is provided on the circulation passage 12. The liquid containing fine bubbles, discharged from the fine-bubble generating nozzle 2, is pumped into the circulation passage 12 by the pump 15 and returned to the mixing nozzle 31. The circulation passage 12 is a sealed pipeline, and the liquid discharged from the fine-bubble generating nozzle 2 is returned to the mixing nozzle 31 in a state of being isolated from the outside air. The liquid returned to the mixing nozzle 31 is passed through the pressurized-liquid generating tank 32, the fine-bubble generating nozzle 2, and the circulation passage 12 and return again to the mixing nozzle 31. In the fine bubble-containing liquid generating apparatus 1, the liquid containing fine bubbles circulates through the generator 11 and the circulation passage 12 in a state of being isolated from the outside air. The density of fine bubbles in the liquid is increased by repetition of this circulation.

In the fine bubble-containing liquid generating apparatus 1, part of the liquid circulating through the generator 11 and the circulation passage 12 is extracted as a fine-bubble containing liquid by the extraction part 13. The extraction part 13 includes an extraction passage 131 and a bubble removing part 132. The extraction passage 131 is connected to the upper end of the excess-gas separating part 326. The bubble removing part 132 is provided on the extraction passage 131 to remove bubbles (i.e., readily visible bubbles) other than fine bubbles from the liquid flowing from the excess-gas separating part 326 into the extraction passage 131. For example, the bubble removing part 132 may be a vent valve. The liquid passing through the bubble removing part 132 is a fine-bubble containing liquid that substantially does not contain readily visible bubbles and that contains a high density of fine bubbles. The fine-bubble containing liquid is extracted from an output port 133 at the tip end of the extraction passage 131.

The fine bubble-containing liquid generating apparatus 1 further includes an extraction controller 134, a bubble-density measuring part 135, and a storage 136. The extraction controller 134 is provided between the bubble removing part 132 and the output port 133 on the extraction passage 131. For example, the extraction controller 134 may be a flow control valve for controlling the flow rate of the fine-bubble containing liquid flowing through the extraction passage 131, and be a valve controller for controlling the degree of opening of the flow control valve. The bubble-density measuring part 135 is connected to the extraction passage 131 between the bubble removing part 132 and the output port 133. The bubble-density measuring part 135 measures the density of fine bubbles in the fine-bubble containing liquid to be extracted from the extraction part 13. The bubble-density measuring part 135 may be implemented by, for example, a technology such as NanoSight Limited's NS500.

The extraction controller 134 is connected to the storage 136. The storage 136 stores flow-rate/density information in advance. The flow-rate/density information indicates a relationship between the extraction flow rate of the fine-bubble containing liquid from the extraction part 13 and the density of fine bubbles in the fine-bubble containing liquid to be extracted from the extraction part 13.

Figure 4:
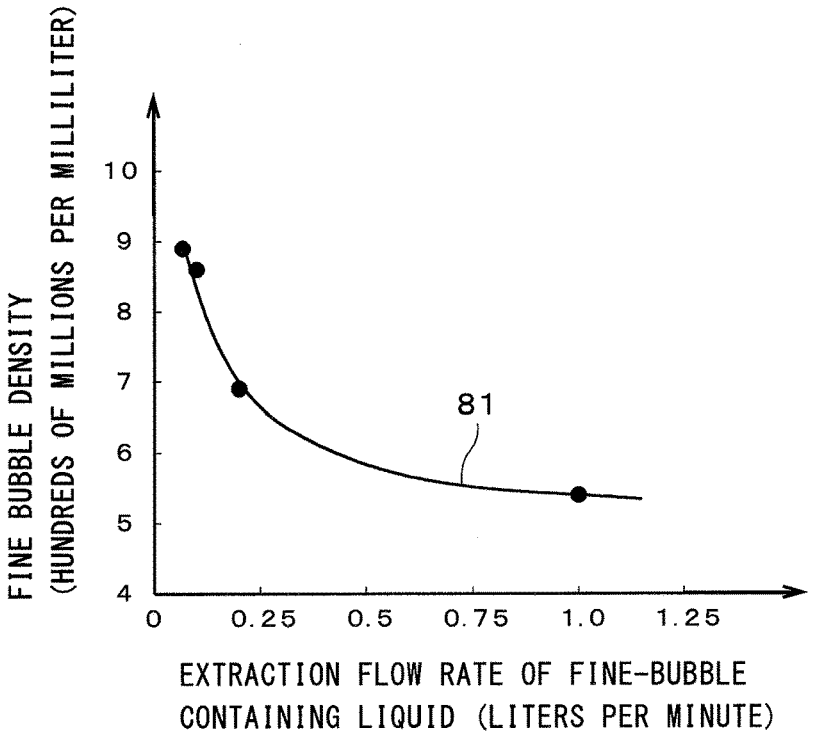
FIG. 4 illustrates flow-rate/density information.

FIG. 4 illustrates the flow-rate/density information. In FIG. 4, the horizontal axis represents the extraction flow rate of the fine-bubble containing liquid, and the vertical axis represents the density of fine bubbles in the fine-bubble containing liquid. A plurality of circles in FIG. 4 indicate the results of measurement of the density of fine bubbles in the fine-bubble containing liquid, extracted at each extraction flow rate of the fine-bubble containing liquid. This measurement is conducted under approximately the same conditions, except for the extraction flow rate. The solid line 81 in FIG. 4 indicates the flow-rate/density information obtained from the circles. As illustrated in FIG. 4, the density of fine bubbles in the fine-bubble containing liquid decreases as the extraction flow rate of the fine-bubble containing liquid increases.

The measurement results obtained by the bubble-density measuring part 135 (i.e., the measured densities of fine bubbles) are transmitted to the extraction controller 134. The extraction controller 134 controls the extraction flow rate of the fine-bubble containing liquid from the extraction part 13 on the basis of a target density that is input in advance, the measurement result obtained by the bubble-density measuring part 135, and the flow-rate/density information stored in the storage 136. As a result, the density of fine bubbles in the fine-bubble containing liquid to be extracted from the extraction part 13 becomes approximately equal to the target density.

Figure 5:
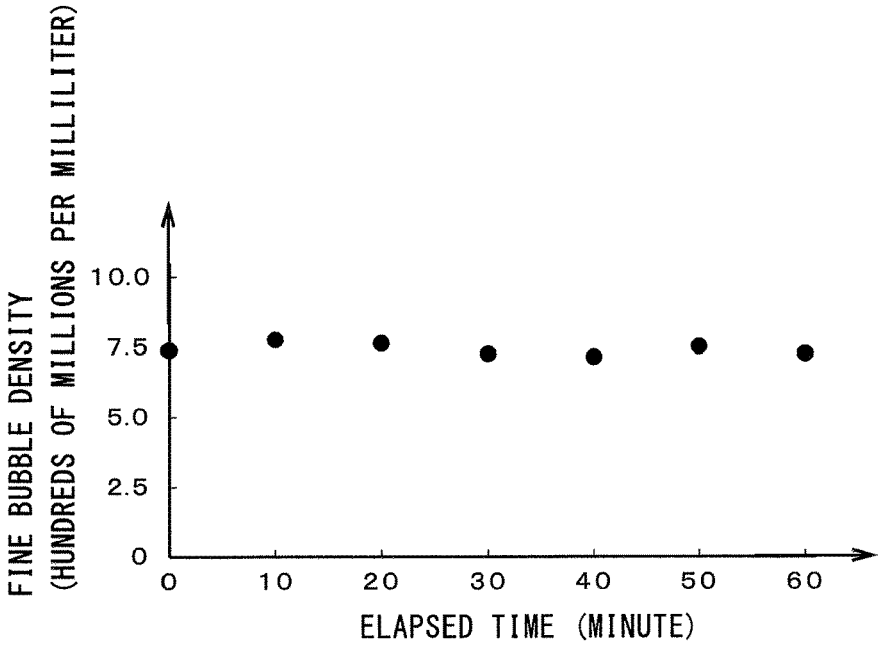
FIG. 5 illustrates a relationship between the elapsed time from the start of extraction and the concentration of fine bubbles in a fine-bubble containing liquid.

FIG. 5 illustrates a relationship between the elapsed time from the start of extraction and the density of fine bubbles in the fine-bubble containing liquid to be extracted, when the fine bubble-containing liquid generating apparatus 1 continuously extracts the fine-bubble containing liquid. In FIG. 5, the horizontal axis represents the elapsed time from the start of extraction of the fine-bubble containing liquid, and the vertical axis represents the density of fine bubbles in the fine-bubble containing liquid. In the fine bubble-containing liquid generating apparatus 1, as a result of control by the extraction controller 134, the fine-bubble containing liquid containing an approximately desired density of fine bubbles can be continuously extracted over a long period of time as illustrated in FIG. 5.

The replenisher 14 is connected to the circulation passage 12 and replenishes the circulation passage 12 with the same type of liquid (in the present embodiment, deionized water) as the liquid circulating through the generator 11 and the circulation passage 12. The replenisher 14 maintains the amount of liquid circulating through the generator 11 and the circulation passage 12 by replenishing the circulation passage 12 with the approximately same amount of liquid as the amount of fine-bubble containing liquid to be extracted from the extraction part 13.

The replenisher 14 includes a liquid supply passage 141, a pressure controller 142, and a replenishment controller 143. One end of the liquid supply passage 141 is connected to the circulation passage 12 between a switching mechanism 162 and the pump 15, and the other end is connected to a liquid supply source 91 that is provided outside the fine bubble-containing liquid generating apparatus 1. The liquid supply source 91 is, for example, a deionized-water supply line that is installed in, for example, a facility to pump deionized water into various apparatuses. The liquid supply passage 141 guides the liquid pumped from the liquid supply source 91 to the circulation passage 12. The liquid supply passage 141 is a sealed pipeline, and the liquid from the liquid supply source 91 is guided to the circulation passage 12 in a state of being isolated from the outside air within the liquid supply passage 141. The pressure controller 142 is provided on the liquid supply passage 141 and controls the pressure of the liquid pumped from the liquid supply source 91 and flowing through the liquid supply passage 141. The pressure controller 142 is, for example, a pressure control valve.

The replenishment controller 143 is connected to the pressure controller 142. When the pressure controller 142 is a pressure control valve, the replenishment controller 143 is, for example, a valve controller for controlling the degree of opening of the pressure control valve. The replenishment controller 143 controls the pressure controller 142 on the basis of the extraction flow rate of the fine-bubble containing liquid from the extraction part 13. More specifically, the replenishment controller 143 controls the pressure or flow rate of the liquid supplied from the replenisher 14 to the circulation passage 12 so that the flow rate (hereinafter, referred to as "replenishment flow rate") of the liquid supplied from the liquid supply passage 141 of the replenisher 14 to the circulation passage 12 is approximately equal to the extraction flow rate of the fine-bubble containing liquid from the extraction part 13. As a result, an approximately constant amount of liquid circulating through the generator 11 and the circulation passage 12 (hereinafter, referred to as "circulation amount") is maintained.

The fine bubble-containing liquid generating apparatus 1 may be configured such that a relationship between the extraction flow rate from the extraction part 13 and the pressure of the liquid supplied from the replenisher 14 when the circulation amount is maintained is stored in advance, and the pressure of the liquid supplied from the replenisher 14 is controlled on the basis of this relationship and the extraction flow rate. Alternatively, a configuration is also possible in which the replenisher 14 is provided with a flowmeter for measuring the replenishment flow rate, and the replenishment controller 143 performs feedback control of the pressure controller 142 so that the measurement result of the flowmeter is equal to the extraction flow rate of the fine-bubble containing liquid from the extraction part 13.

The drain part 16 includes a drain passage 161 and the switching mechanism 162 (e.g., a switching valve such as a three-way valve). One end of the drain passage 161 is connected to the circulation passage 12 between the fine-bubble generating nozzle 2 and the pump 15, and the other end is connected to a drain port 92 that is provided outside the fine bubble-containing liquid generating apparatus 1. In other words, the drain passage 161 branches off from the circulation passage 12 and is connected to the drain port 92. The switching mechanism 162 is provided at the connection (i.e., branch point) between the circulation passage 12 and the drain passage 161 and switches a delivery destination of the liquid received from the fine-bubble generating nozzle 2, between the drain port 92 and the mixing nozzle 31.

The pressure in the generator 11 fluctuates immediately after startup of the fine bubble-containing liquid generating apparatus 1, i.e., immediately after the liquid starts flowing through the generator 11. In view of this, the operation of supplying liquid from the replenisher 14 to the generator 11 through the circulation passage 12 and guiding the liquid passing through the generator 11 to the drain port 92 via the switching mechanism 162 is performed for a predetermined period of time (e.g., several tens of seconds) immediately after startup of the fine bubble-containing liquid generating apparatus 1. At this time, the fine-bubble containing liquid is not extracted from the extraction part 13. In other words, in the state prior to starting the extraction of the fine-bubble containing liquid from the extraction part 13, the liquid led in from the replenisher 14 to the mixing nozzle 31 of the generator 11 through the circulation passage 12 is guided from the fine-bubble generating nozzle 2 to the drain port 92 via the switching mechanism 162, without circulating through the generator 11 and the circulation passage 12. This allows approximately constant pressure to be maintained in the generator 11 and stabilizes the startup of the fine bubble-containing liquid generating apparatus 1.

In the fine bubble-containing liquid generating apparatus 1, when the pressure in the generator 11 becomes approximately constant, the delivery destination of the fine-bubble containing liquid discharged from the fine-bubble generating nozzle 2 is switched by the switching mechanism 162, and the liquid is returned to the mixing nozzle 31 through the circulation passage 12. The fine-bubble containing liquid then circulates through the generator 11 and the circulation passage 12, so that the density of fine bubbles in the liquid is increased to a desired density. The fine-bubble containing liquid is not extracted from the extraction part 13 until the density of fine bubbles in the liquid reaches the desired density, and the replenishment with the liquid from the replenisher 14 is also stopped. When the density of fine bubbles in the liquid circulating through the generator 11 and the circulation passage 12 reaches the desired density, the extraction part 13 starts extracting the fine-bubble containing liquid, and the replenisher 14 also starts replenishment with liquid.

As described above, the fine bubble-containing liquid generating apparatus 1 includes the generator 11 including the mixing nozzle 31 and the fine-bubble generating nozzle 2, the circulation passage 12 for returning the liquid discharged from the fine-bubble generating nozzle 2 to the mixing nozzle 31 in a state in which the liquid is isolated from the outside air, the extraction part 13 for extracting part of the liquid circulating through the generator 11 and the circulation passage 12 as a fine-bubble containing liquid, and the replenisher 14 for replenishing the circulation passage 12 with liquid to maintain the amount of liquid circulating through the generator 11 and the circulation passage 12. With this configuration, it is possible to continuously generate a fine-bubble containing liquid that contains a high density of fine bubbles. As a result, the fine-bubble containing liquid can be continuously supplied in various applications.

Incidentally, apparatuses such as semiconductor manufacturing apparatuses are required to avoid a situation in which processing liquids used in the processing of semiconductor substrates accumulate within the apparatuses before being supplied to the semiconductor substrates. In the fine bubble-containing liquid generating apparatus 1, the fine-bubble containing liquid circulates through the generator 11 and the circulation passage 12 without accumulating within the apparatus, as described above. This makes the fine bubble-containing liquid generating apparatus 1 particularly suitable for the supply of the fine-bubble containing liquid to apparatuses such as semiconductor manufacturing apparatuses. Moreover, in the fine bubble-containing liquid generating apparatus 1, the liquid flowing through the generator 11 at the time of startup of the apparatus is discharged to the drain port 92 without circulating through the generator 11 and the circulation passage 12. This prevents the liquid from accumulating in the apparatus at the time of startup of the fine bubble-containing liquid generating apparatus 1. Accordingly, the fine bubble-containing liquid generating apparatus 1 is even more suitable for the supply of the fine-bubble containing liquid to apparatuses such as semiconductor manufacturing apparatuses.

The fine bubble-containing liquid generating apparatus 1 includes the bubble-density measuring part 135 for measuring the density of fine bubbles in the fine-bubble containing liquid to be extracted from the extraction part 13, the storage 136 for storing the flow-rate/density information, and the extraction controller 134 for controlling the extraction flow rate of the fine-bubble containing liquid from the extraction part 13, on the basis of the measurement result obtained by the bubble-density measuring part 135 and the flow-rate/density information. Thus, it is possible to readily generate a fine-bubble containing liquid that contains a desired density of fine bubbles.

As described above, the replenisher 14 includes the liquid supply passage 141 for guiding the liquid pumped from the liquid supply source 91 to the circulation passage 12, and the pressure controller 142 for controlling the pressure of the liquid flowing through the liquid supply passage 141. Thus, the amount of liquid circulating through the generator 11 and the circulation passage 12 can be readily maintained. Moreover, the replenishment controller 143 controls the pressure or flow rate of the liquid that is supplied from the replenisher 14 to the circulation passage 12, on the basis of the extraction flow rate of the fine-bubble containing liquid from the extraction part 13. This allows the circulation amount to be automatically maintained by replenishment with the liquid from the replenisher 14.

Figure 6:
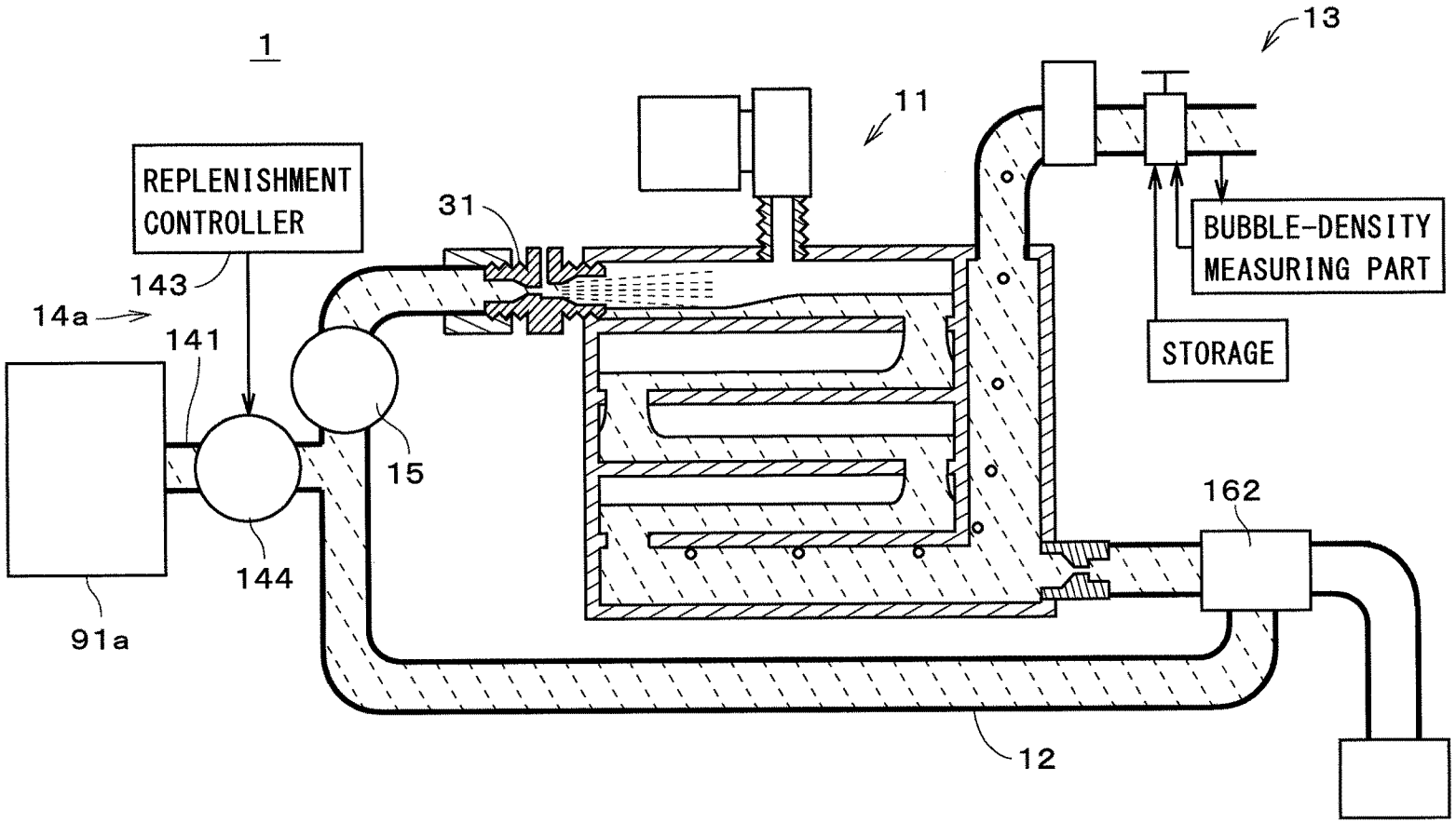
FIG. 6 is a cross-sectional view showing another example of the fine bubble-containing liquid generating apparatus.

The structure of the replenisher 14 in the fine bubble-containing liquid generating apparatus 1 is not limited to the above example, and may be modified in various ways. For example, the fine bubble-containing liquid generating apparatus 1 may include a replenisher **14*a* illustrated in FIG. 6, instead of the replenisher 14 illustrated in FIG. 1. The replenisher 14*a* includes a liquid supply passage 141, a replenishment controller 143, and a pump 144. One end of the liquid supply passage 141 is connected to the circulation passage 12 between the switching mechanism 162 and the pump 15, and the other end is connected to a liquid supply source 91*a* that is provided outside the fine bubble-containing liquid generating apparatus 1. The liquid supply source 91*a* is, for example, a reservoir for storing deionized water. The liquid supply passage 141 guides the liquid from the liquid supply source 91*a* to the circulation passage 12. The liquid supply passage 141 is a sealed pipeline, and the liquid from the liquid supply source 91*a* is guided to the circulation passage 12 in a state of being isolated from the outside air within the liquid supply passage 141. The pump 144 is provided on the liquid supply passage 141 and pumps the liquid flowing through the liquid supply passage 141 toward the circulation passage 12. Thus, the amount of liquid circulating through the generator 11 and the circulation passage 12 (i.e., circulation amount) can be readily maintained as in the case where the replenisher 14 illustrated in FIG. 1** is provided.

The replenishment controller 143 is connected to the pump 144 and controls driving of the pump 144. As a result of the replenishment controller 143 controlling the pump 144, the pressure or flow rate of the liquid supplied from the replenisher **14*a* to the circulation passage 12 is controlled so that the replenishment flow rate from the replenisher 14*a* is approximately equal to the extraction flow rate of the fine-bubble containing liquid from the extraction part 13. Thus, the circulation amount can be automatically maintained by replenishment with the liquid from the replenisher 14*a*, as described above. The replenisher 14*a* may be provided with a flow controller such as a throttle valve in the liquid supply passage 141. In this case, the pump 144 is driven by a given output, and as a result of the replenishment controller 143 controlling this throttle valve, the flow rate of the liquid supplied from the replenisher 14***a* to the circulation passage 12 is controlled so that the replenishment flow rate from the replenisher 14*a* is approximately equal to the extraction flow rate of the fine-bubble containing liquid from the extraction part 13.

Figure 7:
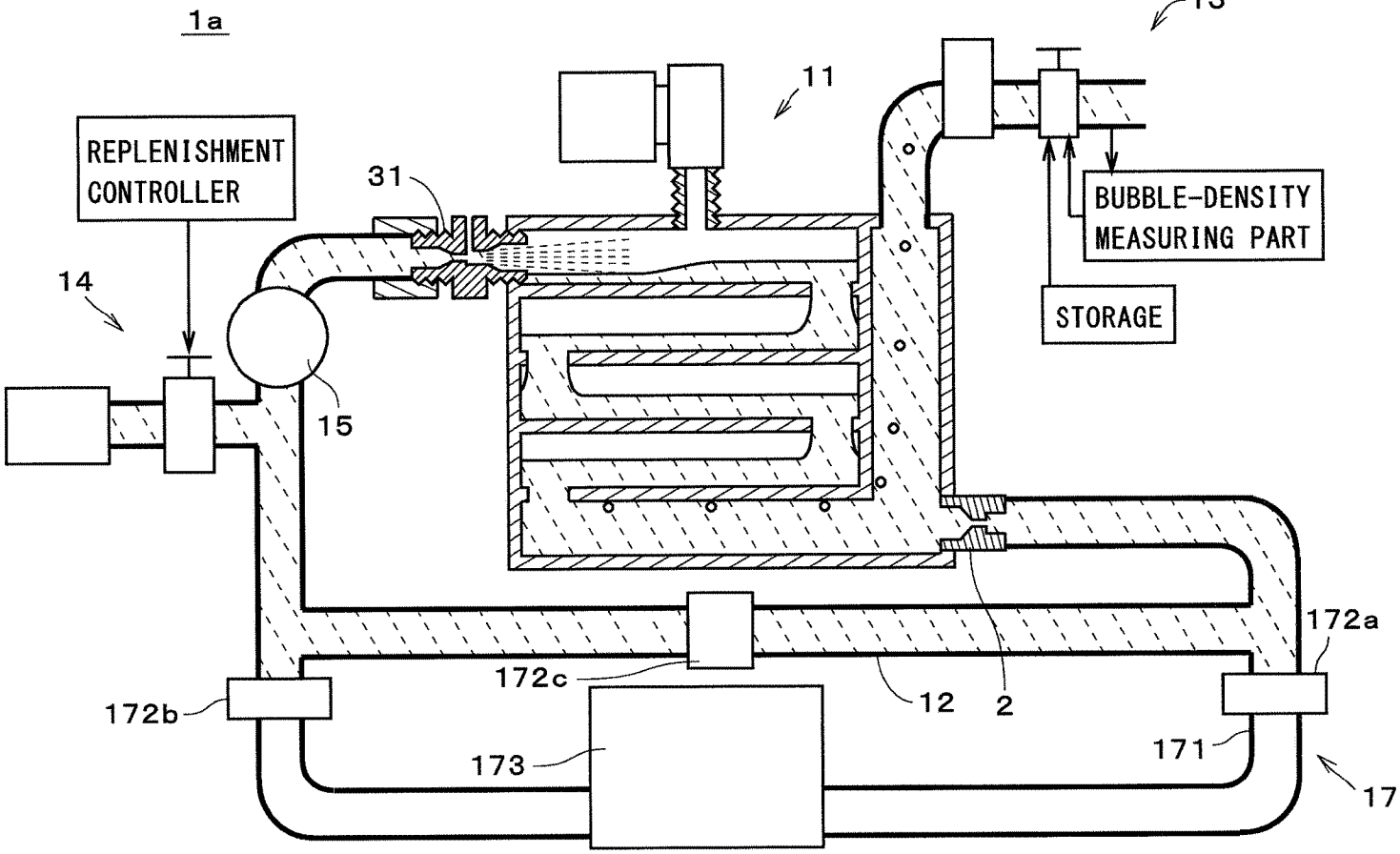
FIG. 7 is a cross-sectional view of a fine bubble-containing liquid generating apparatus according to a second embodiment.

FIG. 7 is a cross-sectional view of a fine bubble-containing liquid generating apparatus 1*a* according to a second embodiment of the present invention. The fine bubble-containing liquid generating apparatus 1*a* includes an initial circulation part 17, instead of the drain part 16 illustrated in FIG. 1. The other constituent elements are identical to those of the fine bubble-containing liquid generating apparatus 1 illustrated in FIG. 1, and the same constituent elements are given the same reference numerals in the following description.

The initial circulation part 17 includes a bypass passage 171, switching mechanisms 172*a*, 172*b*, and 172*c* such as valves, and an initial reservoir 173. One end of the bypass passage 171 is connected to the circulation passage 12 between the fine-bubble generating nozzle 2 and the switching mechanism 172*c*. The other end of the bypass passage 171 is connected to the circulation passage 12 between the switching mechanism 172*c* and the pump 15 on the downstream side of the above one end (i.e., on the forward side in the direction of flow of the liquid in the circulation passage 12). In other words, the bypass passage 171 branches off from the circulation passage 12 at a branch point on the circulation passage 12 and is connected to the circulation passage 12 on the downstream side of the branch point on the circulation passage 12.

The initial reservoir 173 is provided between the switching mechanisms 172*a* and 172*b* on the bypass passage 171 and stores the liquid flowing through the bypass passage 171. The initial reservoir 173 is, for example, a reserve tank capable of storing a certain amount of liquid. Each of the switching mechanisms 172*a* and 172*b* is provided between the circulation passage 12 and the bypass passage 171. The switching mechanisms 172*a*, 172*b*, and 172*c* switch the delivery destination of the liquid from the fine-bubble generating nozzle 2 between the circulation passage 12 and the bypass passage 171.

The pressure in the generator 11 fluctuates immediately after startup of the fine bubble-containing liquid generating apparatus 1*a*, i.e., immediately after the liquid starts flowing through the generator 11. In view of this, the liquid (e.g., deionized water) stored in the initial reservoir 173 is supplied through the bypass passage 171 and the circulation passage 12 to the generator 11 for a predetermined period of time (e.g., several tens of seconds) immediately after startup of the fine bubble-containing liquid generating apparatus 1*a*. The liquid passing through the generator 11 is guided to the bypass passage 171 and to the initial reservoir 173 through the bypass passage 171 by the switching mechanisms 172*a*, 172*b*, and 172*c*, without being guided to the generator 11 via the switching mechanism 172*c*. The liquid is temporarily stored in the initial reservoir 173 and then supplied to the generator 11 through the bypass passage 171. At this time, the fine-bubble containing liquid is not extracted from the extraction part 13.

In other words, in the state prior to starting the extraction of the fine-bubble containing liquid from the extraction part 13, the liquid discharged from the fine-bubble generating nozzle 2 is guided through the bypass passage 171 to the initial reservoir 173, temporarily stored in the initial reservoir 173, and then returned to the mixing nozzle 31 through the bypass passage 171. This allows approximately constant pressure to be maintained in the generator 11 and stabilizes the startup of the fine bubble-containing liquid generating apparatus 1*a*. In addition, the amount of liquid consumed at the time of startup of the apparatus can be reduced because the liquid is not discharged to the outside of the apparatus at the time of startup of the fine bubble-containing liquid generating apparatus 1*a*.

In the fine bubble-containing liquid generating apparatus 1*a*, when the pressure in the generator 11 becomes approximately constant, the delivery destination of the fine bubble-containing liquid discharged from the fine-bubble generating nozzle 2 is switched by the switching mechanisms 172*a*, 172*b*, and 172*c* so that the liquid is returned to the mixing nozzle 31 via the switching mechanism 172*c* in the circulation passage 12 without passing through the bypass passage 171 and the initial reservoir 173. Then, the fine bubble-containing liquid circulates through the generator 11 and the circulation passage 12, and therefore the density of fine bubbles in the liquid is increased to the desired density. The fine-bubble containing liquid is not extracted from the extraction part 13 until the density of fine bubbles in the liquid reaches the desired density, and the supply of liquid from the replenisher 14 is also stopped.

When the density of fine bubbles in the liquid circulating through the generator 11 and the circulation passage 12 reaches the desired density, the extraction of the fine-bubble containing liquid from the extraction part 13 is started, and the supply of liquid from the replenisher 14 is also started. In this way, in the fine bubble-containing liquid generating apparatus 1*a*, the liquid discharged from the fine-bubble generating nozzle 2 is returned through the circulation passage 12 to the mixing nozzle 31 while the fine-bubble containing liquid is being extracted from the extraction part 13. Accordingly, it is possible to continuously generate the fine-bubble containing liquid that contains a high density of fine bubbles, as in the fine bubble-containing liquid generating apparatus 1 illustrated in FIG. 1.

Figure 8:
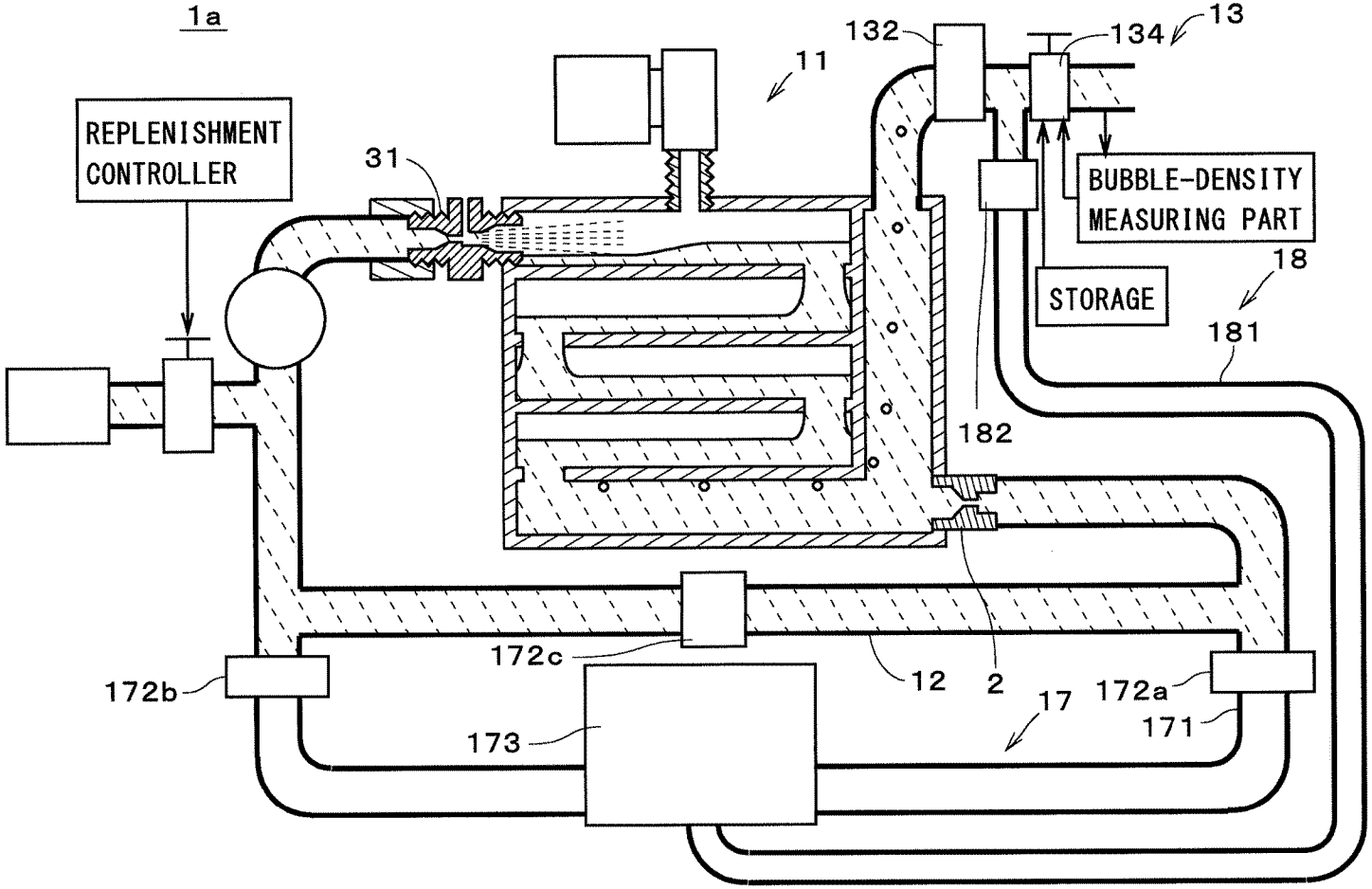
FIG. 8 is a cross-sectional view of another fine bubble-containing liquid generating apparatus.

The fine bubble-containing liquid generating apparatus 1*a* may further include another initial circulation part 18 as illustrated in FIG. 8. The initial circulation part includes a bypass passage 181 and a switching mechanism 182 such as a valve. One end of the bypass passage 181 is connected to the extraction part 13 between the bubble removing part 132 and the extraction controller 134. The other end of the bypass passage 181 is connected to a predetermined part (in FIG. 8, the initial reservoir 173) out of the bypass passage 171 between the switching mechanisms 172*a* and 172*b* and the initial reservoir 173 of the initial circulation part 17. The switching mechanism 182 is provided on the bypass passage 181 and operates in synchronization with the switching mechanisms 172*a*, 172*b*, and 172*c*. That is, when the switching mechanisms 172*a*, 172*b*, and 172*c* supply the liquid stored in the initial reservoir 173 to the generator 11 through the bypass passage 171 and the circulation passage 12 without supplying the liquid to the generator 11 via the switching mechanism 172*c*, the switching mechanism 182 guides the liquid from which bubbles other than fine bubbles have been removed, from the bubble removing part 132 to the initial circulation part 17. The switching mechanism 182 does not guide the liquid from the bubble removing part 132 to the initial circulation part 17 when the switching mechanisms 172*a*, 172*b*, and 172*c* return the liquid from the fine-bubble generating nozzle 2 to the mixing nozzle 31 via the switching mechanism 172*c* in the circulation passage 12 without passing the liquid through the bypass passage 171 and the initial reservoir 173. As described above, the addition of the initial circulation part 18 increases the efficiency of circulation of the liquid in the generator 11.

The fine bubble-containing liquid generating apparatuses 1 and 1*a* described above may be modified in various ways.

For example, the liquid that is mixed with the gas in the mixing nozzle 31 is not limited to pure water, and may be a liquid consisting primarily of water. For example, the above liquid may be water with additives or a nonvolatile liquid. The liquid may also be ethyl alcohol. The gas that forms fine bubbles is not limited to nitrogen, and may be air or other gas. However, it is necessary for the gas to be insoluble or poorly soluble in the liquid.

In the fine bubble-containing liquid generating apparatuses 1 and 1*a*, the extraction part 13 does not necessarily have to be connected to the excess-gas separating part 326 of the pressurized-liquid generating tank 32 as long as it is possible to extract part of the liquid circulating through the generator 11 and the circulation passage 12 as a fine-bubble containing liquid. For example, the extraction part 13 may be connected to a part other than the excess-gas separating part 326 of the generator 11, and may be connected to the circulation passage 12 between the fine-bubble generating nozzle 2 and the pump 15.

The structure of the generator 11 may be modified in various ways, and the generator 11 may have a different structure. For example, the fine-bubble generating nozzle 2 may include a plurality of pressurized-liquid outlets 22. The fine-bubble generating nozzle 2 does not necessarily have to be directly connected to the fifth flow passage 325 of the pressurized-liquid generating tank 32, and the downstream end of the fifth flow passage 325 and the fine-bubble generating nozzle 2 may be connected by a sealed connection passage. The passages in the pressurized-liquid generating tank 32 may have circular cross-sectional shapes. The mixture of gas and liquid may be implemented by other methods such as mechanical agitation.

The fine-bubble containing liquid generated by the fine bubble-containing liquid generating apparatuses 1 and 1*a* may be used in various applications that have heretofore been proposed for conventional fine-bubble containing liquid. The fine-bubble containing liquid may be used in novel fields, and conceivable fields of application span a diverse range. Examples include food products, beverages, cosmetics, drugs, medical treatment, plant cultivation, semiconductor devices, flat panel displays, electronic equipment, solar cells, secondary batteries, new functional materials, and radioactive material removal.

The configurations of the above-described preferred embodiments and variations may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention.

REFERENCE SIGNS LIST

1, 1*a* Fine bubble-containing liquid generating apparatus
2 Fine-bubble generating nozzle
11 Generator
12 Circulation passage
13 Extraction part
14, 14*a* Replenisher
31 Mixing nozzle
91, 91*a* Liquid supply source
92 Drain port
134 Extraction controller
135 Bubble-density measuring part
136 Storage
141 Liquid supply passage
142 Pressure controller
143 Replenishment controller
144 Pump
161 Drain passage
162 Switching mechanism
171 Bypass passage
172*a*, 172*b*, 172*c* Switching mechanism
173 Initial reservoir

The invention claimed is:

1. A fine bubble-containing liquid generating apparatus comprising:

a generator including a lead-in part configured to lead in gas and pressurized liquid, a pressurized-liquid generating tank comprising an interior which is configured to be pressurized to a state in which a pressure is higher than atmospheric pressure, wherein said pressurized-liquid generating tank is configured to dissolve the gas led in from said lead-in part in the liquid under pressure to generate a pressurized liquid, and a discharge part including a fine-bubble generating nozzle, configured to generate and discharge liquid that contains fine bubbles of the gas from said pressurized liquid provided from said pressurized-liquid generating tank;

a circulation passage configured to return liquid discharged from said discharge part to said lead-in part in a state in which the liquid is isolated from outside air, wherein one end portion of said circulation passage is connected to said discharge part and the other end portion of said circulation passage is connected to said lead-in part;

an extraction part configured to extract, as a fine-bubble containing liquid, part of liquid circulating through said generator and said circulation passage; and a replenisher configured to replenish said circulation passage with liquid to maintain an amount of liquid circulating through said generator and said circulation passage constant, and the circulation of the liquid in said generator and said circulation passage is repeated until the density of fine bubbles included in the liquid circulating in said generator and said circulation passage reaches a desired density, and the amount of liquid circulating in said generator and said circulation passage is maintained constant by making the flow rate of the liquid supplied from said replenisher equal to the flow rate of the fine-bubble containing liquid extracted from said extraction part.

2. The fine bubble-containing liquid generating apparatus according to claim 1, further comprising:

a drain passage that branches off from said circulation passage and is connected to a drain port; and a switching mechanism for switching a delivery destination of liquid discharged from said discharge part between said lead-in part and said drain port, wherein in a state prior to starting extraction of the fine-bubble containing liquid from said extraction part, the liquid led in from said replenisher to said lead-in part through said circulation passage is guided from said discharge part to said drain port by said switching mechanism.

3. The fine bubble-containing liquid generating apparatus according to claim 2, wherein said replenisher includes:

a liquid supply passage for guiding liquid pumped from a liquid supply source to said circulation passage; and a pressure controller provided on said liquid supply passage and for controlling a pressure of liquid flowing through said liquid supply passage.

4. The fine bubble-containing liquid generating apparatus according to claim 3, comprising:

a replenishment controller for controlling a pressure or flow rate of liquid supplied from said replenisher to said circulation passage, on the basis of an extraction flow rate of the fine-bubble containing liquid from said extraction part.

5. The fine bubble-containing liquid generating apparatus according claim 2, wherein said replenisher includes:

a liquid supply passage for guiding liquid from a liquid supply source to said circulation passage; and a pump provided on said liquid supply passage and for pumping liquid in said liquid supply passage toward said circulation passage.

6. The fine bubble-containing liquid generating apparatus according to claim 5, further comprising:

a replenishment controller for controlling a pressure or flow rate of liquid supplied from said replenisher to said circulation passage, on the basis of an extraction flow rate of the fine-bubble containing liquid from said extraction part.

7. The fine bubble-containing liquid generating apparatus according to claim 2, further comprising:

a bubble-density measuring part for measuring a density of fine bubbles in the fine-bubble containing liquid to be extracted from said extraction part;

a storage for storing flow-rate/density information that indicates a relationship between an extraction flow rate of the fine-bubble containing liquid from said extraction part and a density of fine bubbles in the fine-bubble containing liquid to be extracted from said extraction part; and an extraction controller for controlling an extraction flow rate of the fine-bubble containing liquid from said extraction part, on the basis of a measurement result obtained by said bubble-density measuring part and said flow-rate/density information.

8. The fine bubble-containing liquid generating apparatus according to claim 1, further comprising:

a bypass passage that branches off from said circulation passage and is connected to said circulation passage on a downstream side of a branch point;

an initial reservoir provided on said bypass passage and for storing liquid; and a switching mechanism provided between said circulation passage and said bypass passage, wherein said switching mechanism performs switching such that:

prior to starting extraction of the fine-bubble containing liquid from said extraction part, the liquid discharged from said discharge part is guided to said initial reservoir through said bypass passage, temporally stored in said initial reservoir, and returned to said lead-in part through said bypass passage, and during the extraction of the fine-bubble containing liquid from said extraction part, the liquid discharged from said discharge part is returned to said lead-in part through said circulation passage.

9. The fine bubble-containing liquid generating apparatus according to claim 8, wherein said replenisher includes:

a liquid supply passage for guiding liquid pumped from a liquid supply source to said circulation passage; and a pressure controller provided on said liquid supply passage and for controlling a pressure of liquid flowing through said liquid supply passage.

10. The fine bubble-containing liquid generating apparatus according to claim 9, further comprising:

a replenishment controller for controlling a pressure or flow rate of liquid supplied from said replenisher to said circulation passage, on the basis of an extraction flow rate of the fine-bubble containing liquid from said extraction part.

11. The fine bubble-containing liquid generating apparatus according to claim 8, wherein said replenisher includes:

a liquid supply passage for guiding liquid from a liquid supply source to said circulation passage; and a pump provided on said liquid supply passage and for pumping liquid in said liquid supply passage toward said circulation passage.

12. The fine bubble-containing liquid generating apparatus according to claim 11, further comprising:

a replenishment controller for controlling a pressure or flow rate of liquid supplied from said replenisher to said circulation passage, on the basis of an extraction flow rate of the fine-bubble containing liquid from said extraction part.

13. The fine bubble-containing liquid generating apparatus according to claim 8, further comprising:

a bubble-density measuring part for measuring a density of fine bubbles in the fine-bubble containing liquid to be extracted from said extraction part;

a storage for storing flow-rate/density information that indicates a relationship between an extraction flow rate of the fine-bubble containing liquid from said extraction part and a density of fine bubbles in the fine-bubble containing liquid to be extracted from said extraction part; and an extraction controller for controlling an extraction flow rate of the fine-bubble containing liquid from said extraction part, on the basis of a measurement result obtained by said bubble-density measuring part and said flow-rate/density information.

14. The fine bubble-containing liquid generating apparatus according to claim 1, wherein said replenisher includes:

a liquid supply passage for guiding liquid pumped from a liquid supply source to said circulation passage; and a pressure controller provided on said liquid supply passage and for controlling a pressure of liquid flowing through said liquid supply passage.

15. The fine bubble-containing liquid generating apparatus according to claim 14, further comprising:

a replenishment controller for controlling a pressure or flow rate of liquid supplied from said replenisher to said circulation passage, on the basis of an extraction flow rate of the fine-bubble containing liquid from said extraction part.

16. The fine bubble-containing liquid generating apparatus according to claim 1, wherein said replenisher includes:

a liquid supply passage for guiding liquid from a liquid supply source to said circulation passage; and a pump provided on said liquid supply passage and for pumping liquid in said liquid supply passage toward said circulation passage.

17. The fine bubble-containing liquid generating apparatus according to claim 16, further comprising:

a replenishment controller for controlling a pressure or flow rate of liquid supplied from said replenisher to said circulation passage, on the basis of an extraction flow rate of the fine-bubble containing liquid from said extraction part.

18. The fine bubble-containing liquid generating apparatus according to claim 1, further comprising:

a bubble-density measuring part for measuring a density of fine bubbles in the fine-bubble containing liquid to be extracted from said extraction part;

a storage for storing flow-rate/density information that indicates a relationship between an extraction flow rate of the fine-bubble containing liquid from said extraction part and a density of fine bubbles in the fine-bubble containing liquid to be extracted from said extraction part; and an extraction controller for controlling an extraction flow rate of the fine-bubble containing liquid from said extraction part, on the basis of a measurement result obtained by said bubble-density measuring part and said flow-rate/density information.

19. The fine bubble-containing liquid generating apparatus according to claim 1, wherein said extraction part is connected to said circulation passage between a portion to which said replenisher is connected and said one end portion.

20. The fine bubble-containing liquid generating apparatus according to claim 1, wherein said discharge part generates said fine bubbles having a diameter of 100 μm or less.

* * * * *